US005930861A

United States Patent [19]

White

[11] Patent Number: 5,930,861

[45] Date of Patent: Aug. 3, 1999

[54] GINGIVAL STIMULATOR

[76] Inventor: Dennis J White, 51 Nostrand Rd., Cranbury, N.J. 08512

[21] Appl. No.: 08/914,164

[22] Filed: Aug. 19, 1997

Related U.S. Application Data

[60] Provisional application No. 60/025,654, Sep. 9, 1996.

[51] Int. Cl.[6] ..... A46B 9/04

[52] U.S. Cl. ..... 15/167.1; 15/110; 15/207.2; 132/309; 601/141

[58] Field of Search ..... 15/207.2, 167.1, 15/106, 110; 132/309, 321; 433/142; 601/141

[56] References Cited

U.S. PATENT DOCUMENTS

| | | | |
|---|---|---|---|
| 1,924,152 | 8/1933 | Coney et al. | 15/167.1 |
| 3,698,405 | 10/1972 | Walker . | |
| 3,896,824 | 7/1975 | Thornton | 132/89 |
| 4,167,794 | 9/1979 | Pomeroy | 15/188 |
| 4,373,541 | 2/1983 | Nishioka | 15/167.1 |
| 4,450,849 | 5/1984 | Cerceo et al. | 132/89 |
| 4,462,136 | 7/1984 | Nakao | 15/167 |
| 4,766,633 | 8/1988 | Clark | 15/110 X |
| 5,027,796 | 7/1991 | Linzey | 15/167.1 X |
| 5,678,275 | 10/1997 | Derfner | 15/167.1 |

*Primary Examiner*—Elizabeth McKane

[57] ABSTRACT

A dental/gingival stimulating article is disclosed that provides interdental stimulation and plaque removal to several teeth at once. This design holds many stimulator tips that have broadened but narrow profile paddle ends. The instrument is held in one hand and directed with appropriate direction and force to guide fiber ends into the spaces between the gum and teeth. It will reach several papillary areas. The rotational direction used on the handle will dissipate to a massaging motion within the sulci. Therefore, the threat of interproximal caries is reduced and the occurrence of periodontal disease is minimized.

2 Claims, 4 Drawing Sheets

GINGIVAL STIMULATOR

The present application is a continuation of the provisional application 60/025,654, filed Sep. 9, 1996.

FIELD OF THE INVENTION

This invention discloses a device, which is both efficient and easy to use, to stimulate gums and clean teeth in inaccessible areas.

BACKGROUND OF THE INVENTION

Regarding dental hygiene, it has been found desirable to remove residual food particles and plaque ingrained between the teeth and under the gums. In fact, irritation occurs when food and plaque are left to remain between the teeth. This leads to tooth decay and periodontitis. Moderate to severe periodontitis will cause recession of gums, mobility of teeth, and even tooth loss. Teeth must be brushed and adjacent soft tissue massaged in order to maintain oral health.

A biomechanical problem exists with toothbrushing. There is a fine line between one keeping teeth adequately clean and one being overzealous and causing tooth abrasion and gingival recession from overbrushing. Harmful stress to oral tissues can be caused by a toothbrush on gingival tissue when an individual tries to reach deeper inaccessible areas between the teeth.

A normal toothbrush is effective for cleaning areas of the teeth exposed to the brush, but the professionals are in agreement that the bristles can not reach into deeper areas between the teeth. A favorable way to clean this interdental area is to use a length of string, commonly called dental floss. The intended motion of such floss is to have it seesaw through the contacts and be directed gently into the sulcus. It is then curved around the teeth, and then lifted in the incisal direction while putting force toward the tooth surface being cleaned.

To floss the entire dentition is time consuming. To accomplish this feat for all the teeth is very difficult. The back teeth must be done blindly, and many people don't have the dexterity to accomplish the task.

The interdental area is also maintained by interproximal brushes. However, in a normal and healthy interdental area the space between the teeth is consumed by the dental papilla and this precludes the use of a small brush. The interdental brush is generally recommended by dentists to the older population.

Tooth picks and Johnson and Johnson's Stimudents are utilized to remove accessible plaque. However, they are too bulky to be placed into the delicate interdental sulcular area.

In U.S. Pat. No. 3,896,824 Thornton reveals a type of interdental massager that is an efficient type of dental floss. Difficulty arises when it is snapped through a tight contact. It is also arduous to clean an entire mouth at one time.

In U.S. Pat. No. 4,450,849 Cereo et al. disclose a type of dental tape or floss with rows of protuberances. This gingival stimulator suffers from inefficiency. It is very time consuming to place this type of device between each dental contact. Compliance on a regular basis could only be done by a very dedicated individual.

In U.S. Pat. No. 4,462,136 Nakao et al. invents a massaging device with small rows of fibers wrapped in a sheath. The shape of this stimulator is somewhat converging and it is this converging shape itself that makes for an inefficient design for entering into the sulcular area.

OBJECTS AND ADVANTAGES

The object of this invention is to deliver efficiency in the area of gingival stimulation. The average person does not wish to take the time to floss between teeth. It is technically very challenging and there is little feel better/look better reward afterward, even when done properly. It does not truly stimulate the gum since it is held against the teeth and there is not a strong contact to the soft tissue. Flossing has a passive effect on the gums. Floss removes plaque from the teeth not the gums. Gingiva will maintain health because nearby plaque is absent.

The stimulator of the present invention comes into intimate contact with the sulcular epithelium and has a direct role in massaging the gum. It feels good and this positive feedback supports use.

Another advantage of this invention is that its use is not time consuming. The disclosed stimulator massages several teeth at one time. Its efficient use thus promotes compliance. Also, the invention does not have to pass though an interproximal contact. The stimulator is passed from either the buccal or the lingual direction and circumvents the problem of entering through the contact.

The contact has always been a drawback to use of dental floss and yet this is not an area we are purposefully attempting to clean. The contact is self cleaning and is always free of plaque.

This disclosure differs from a toothbrush in that the tips are fewer in number, so that they have the ability to penetrate deeper. The force of a large number of bristles, as in toothbrushes used today, press against surrounding tooth and gingiva. Thus the surrounding tissues prevent the necessary deeper stimulation interproximally and into the sulcus by the individual fibers. The surrounding areas may become damaged since they are overbrushed and even traumatized. The inaccessible areas suffer from lack of stimulation. Another advantage of this disclosure is that the end of the gingival stimulator is rounded. This rounded tip prevents undue stress to be exerted onto the delicate soft tissue. This will help prevent undue recession at the hands of an overzealous user.

The entire process is done with one hand.

The stimulator tip is supported by a smaller shaft. The advantage of this design is that the stimulator tip is free to negotiate curved areas of teeth. The fact that the supporting shaft is smaller in diameter than the tip, allows the free gingival crest to fall against the stimulator tip and not be held away by a heavy supporting shaft.

DETAILED DESCRIPTION OF THE INVENTION

Figure 1:
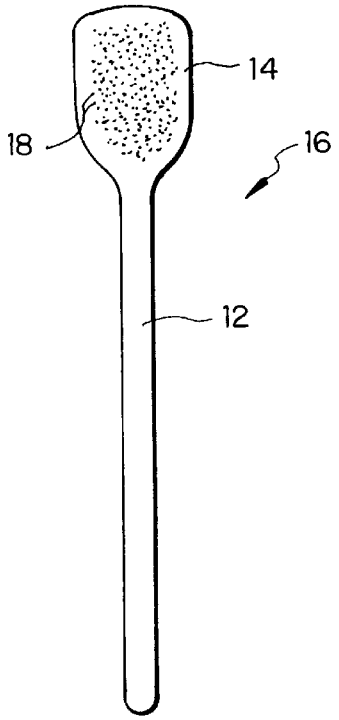
FIG. 1 is a frontal view of a single stimulator tip.

The individual stimulator tip, 16 in FIG. 1, of this disclosure has a broadened planar work area, 14. This is supported by a thin stem, 12.

Figure 2:
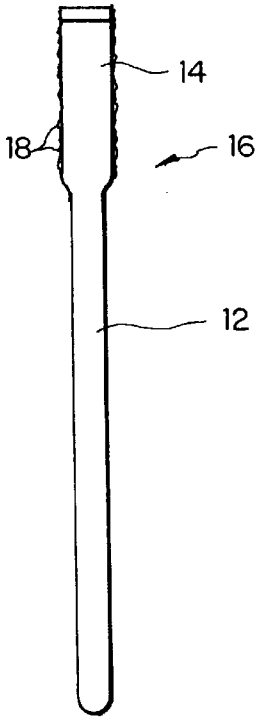
FIG. 2 is a lateral view of a disclosed stimulator tip.
Figure 3:
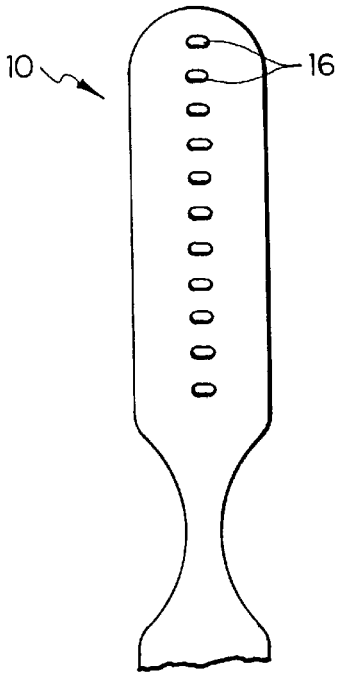
FIG. 3 is a top view of a straight line arrangement of stimulator tips attached to a handle.
Figure 4:
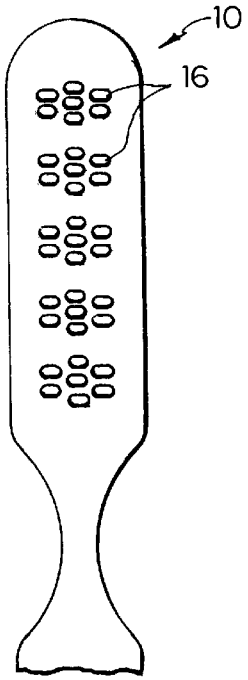
FIG. 4 is top view of an array of gingival stimulator tips affixed to handle.
Figure 8:
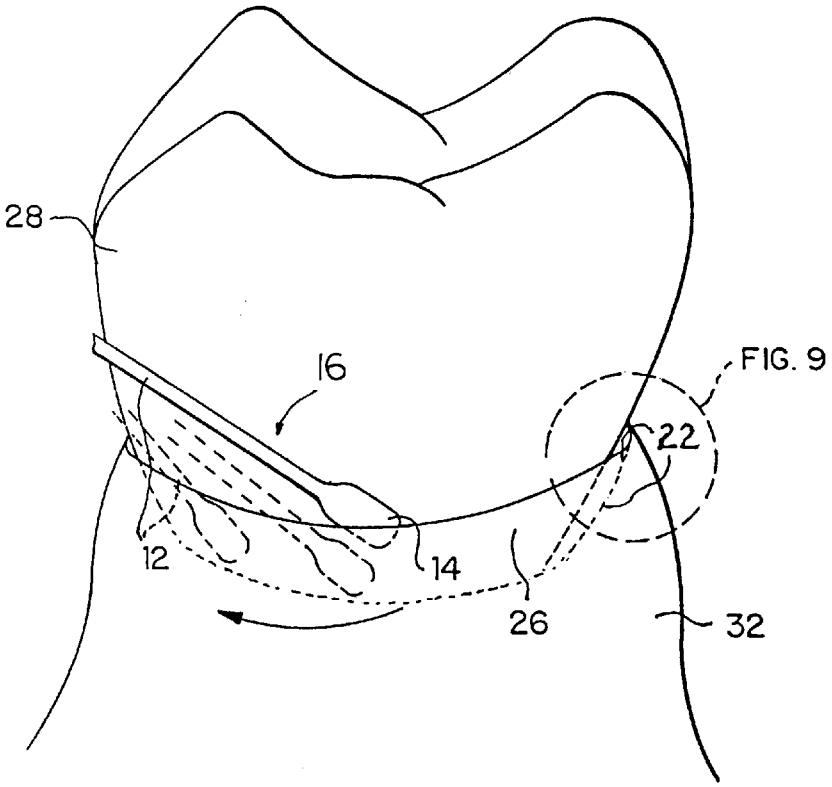
FIG. 8 is a frontal view of a molar and gingival area with one stimulator active in a sweeping motion in sulcus and also indicating a blowup location used for FIG. 9

The slim profile of the work area, 14, FIG. 2, allows easy passage into thin sulcular area. FIGS. 1, and 2 also reveal that the planar work area, 14, has an irregular surface or protuberances, 18. Both the face and reverse sides have these random projections, 18. FIG. 8 shows the adaptability of the planar work areas, 14 into the sulcus, 26.

Figure 9:
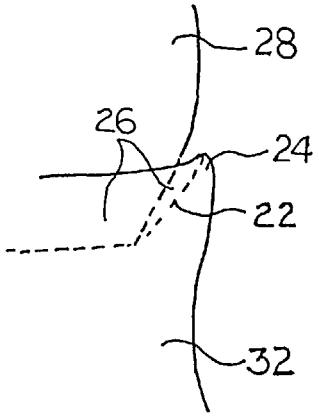
FIG. 9 is an enlarged area of gingival sulcus.

Thus, the stimulator, 10, FIGS. 3,4,5, and 6, is held in similar fashion as a conventional toothbrush. The array of stimulator tips is placed softly at the gumline. The handle is moved in a circular fashion while increasing pressure onto the stimulator toward the sulcus, 26. The broad, yet narrow profile stimulator tip, 16, will navigate between tooth, 28 and free gingival margin, 24, FIG. 9, and come to rest in the gingival sulcus, 26 FIG. 8. Circular motion will cause the projections, 18 of the working area, 14 to massage the sulcular epithelial lining, 22 and to clean adjacent tooth enamel, 28, FIG. 8.

Figure 5:
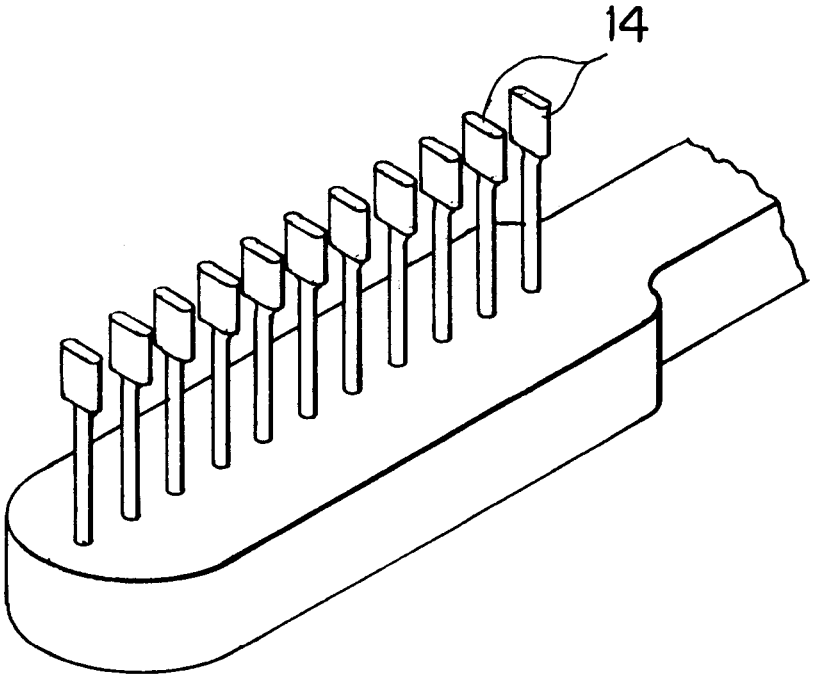
FIG. 5 is lateral perspective view of stimulator tips arranged in a straight line and affixed to a handle.

Several of the stimulator tips can be arranged onto a base and handle. FIG. 5 shows a straight line arrangement of the stimulators tips, 16, to form the stimulator, 10. This arrangement would put the least amount of pressure on the surrounding gum, 32, and focus the direction of the bristles into the free gingival margin, 24.

Figure 6:
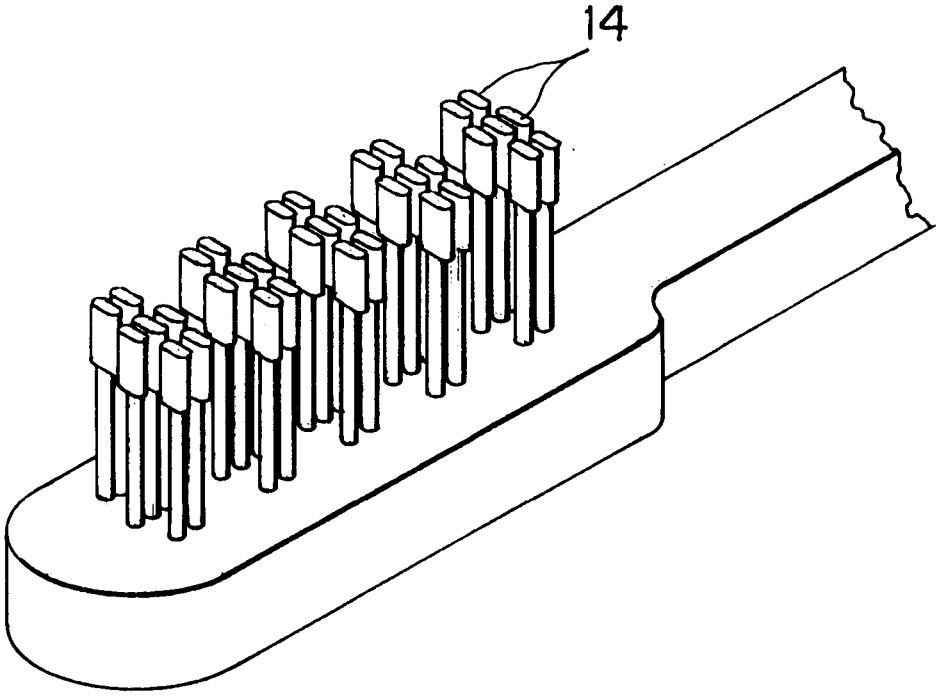
FIG. 6 is a lateral perspective of stimulator tips arranged in clusters and affixed to a handle.
Figure 7:
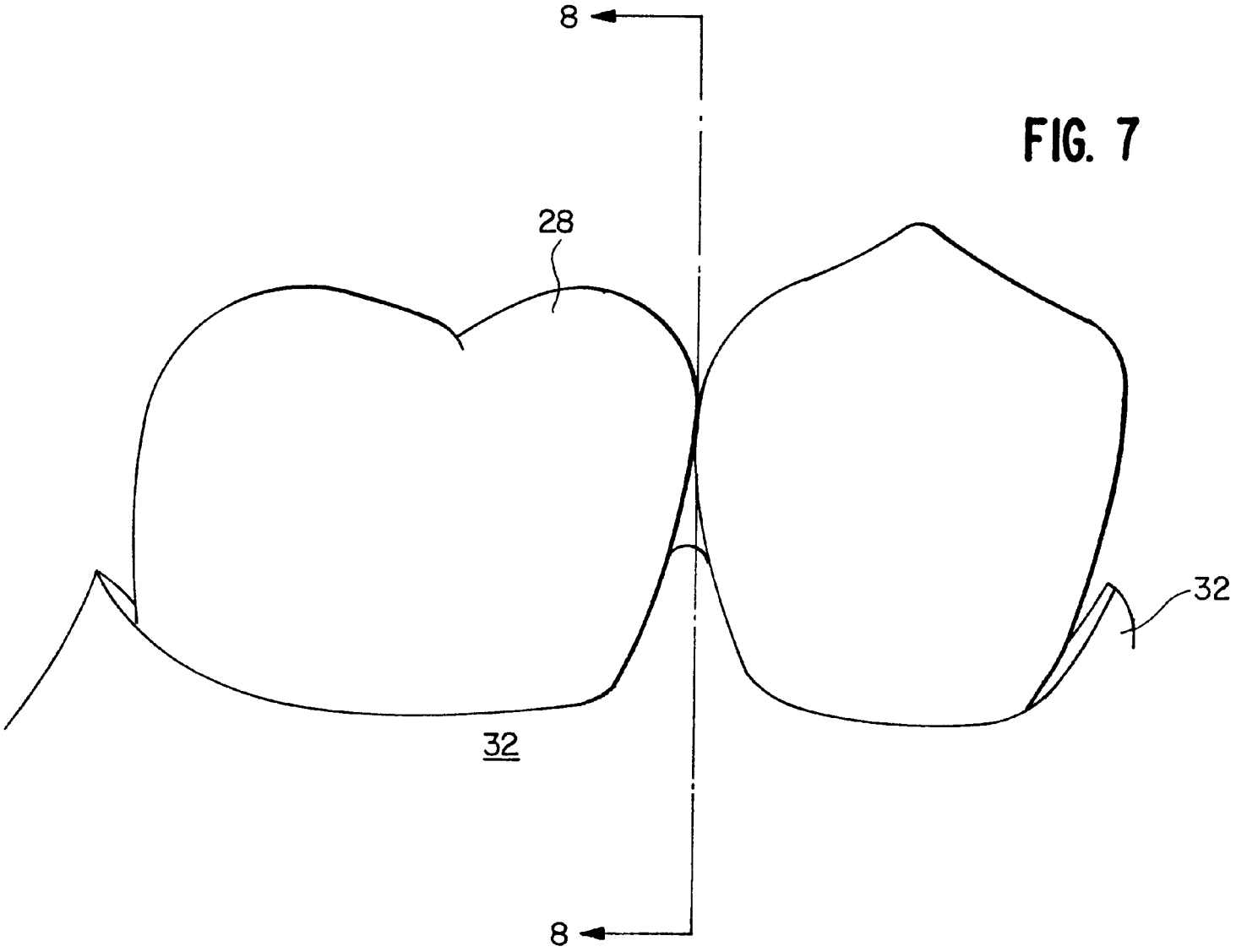
FIG. 7 is a lateral view of two teeth showing interdental papilla and also indicating location of frontal perspective of FIG. 8.

FIG. 6 shows five cluster arrangements of stimulator tips, 16, to form a stimulator, 10. This design would facilitate placement of stimulator tips between teeth. The intercluster spacing of tips would simulate width of teeth.

The arrangement could also be totally at random, this is not shown. This arrangement would accommodate placement around the broad surface of tooth area facing the stimulator.

CONCLUSIONS, RAMIFICATIONS AND SCOPE OF INVENTION

So it can be seen by the reader that the invention disclosed herein is an efficient dental instrument for stimulating the gum. It differs from other present day devices because it has all of the following advantages:

It stimulates deep interdental soft tissue—this area is inaccessible to toothbrushes.

It has flattened broad surfaces—corresponding to sulcular anatomy.

The stimulator does not have to pass through a dental contact area.—this is the biggest deterrent to regular flossing.

Many interdental areas may by reached simultaneously—most people can't devote the time to cleaning each interproximal area separately.

The rounded end will not cause injury to soft tissue—most adults have recession which is self inflicted due to overzealous toothbrushing.

The smaller supporting shaft of the stimulator tip is flexible and accommodates the curves of the teeth—this allows several interdental areas to be done at once.

The unique feeling of actually massaging gums in an efficient method will encourage its use on a regular basis.

The present disclosure will therefore make it easier for people to maintain oral health. Users would be less susceptible to periodontitis and tooth decay.

I claim:

1. A gingival stimulator for massaging gums and removing plaque from teeth comprising:

a stem having a proximal end and a distal end;

a planar portion attached to said stem at said distal end and having a width greater than its thickness and wherein the thickness of the planar portion is sufficiently small to enable entry into the interproximal gingival sulci and the width is sufficiently great to prevent trauma to soft tissue, said planar portion comprised of two opposed planar sides; and protuberances disposed on each of said opposed planar sides.

2. A prophylactic dental article for massaging gums and removing plaque from teeth comprising:

a plurality of gingival stimulators wherein said gingival stimulators each comprise a stem having a proximal end and a distal end, a planar portion attached to said stem at said distal end and having a width greater than its thickness and wherein the thickness of the planar portion is sufficiently small to enable entry into the interproximal gingival sulci and the width is sufficiently great to prevent trauma to soft tissue, said planar portion comprised of two opposed planar sides, and protuberances disposed on each of said opposed planar sides; and a common base supporting said plurality of gingival stimulators at each proximal end thereof.

* * * * *